US010358325B2

(12) United States Patent
Walker

(10) Patent No.: US 10,358,325 B2
(45) Date of Patent: Jul. 23, 2019

(54) OPEN WHEEL VEHICLE SPEED JACK

(71) Applicant: William R. Walker, Henderson, NV (US)

(72) Inventor: William R. Walker, Henderson, NV (US)

( * ) Notice: Subject to any disclaimer, the term of this patent is extended or adjusted under 35 U.S.C. 154(b) by 44 days.

(21) Appl. No.: 15/287,950

(22) Filed: Oct. 7, 2016

(65) Prior Publication Data

US 2017/0101295 A1 Apr. 13, 2017

Related U.S. Application Data

(60) Provisional application No. 62/238,390, filed on Oct. 7, 2015.

(51) Int. Cl.
*B66F 3/00* (2006.01)

(52) U.S. Cl.
CPC ..... *B66F 3/005* (2013.01); *B66F 3/00* (2013.01)

(58) Field of Classification Search
USPC ..... 254/120, 131, 131.5, 256
See application file for complete search history.

(56) References Cited

U.S. PATENT DOCUMENTS 2,309,769 A * 2/1943 Hubbard ..... B66C 23/203 24/279
2,807,380 A * 9/1957 Boehnke ..... B60B 29/002 254/8 R
3,907,254 A * 9/1975 Richards ..... B66F 15/00 254/131
3,964,729 A * 6/1976 Harlow ..... B66F 15/00 254/131
4,250,769 A * 2/1981 Herring ..... A01G 17/16 254/129
4,552,337 A * 11/1985 Wille ..... B25B 5/085 254/106
5,499,795 A * 3/1996 Mathews ..... E04H 17/265 254/30
5,833,215 A * 11/1998 Vandenburg ..... E04H 17/265 254/30
7,611,129 B1 * 11/2009 Stahm ..... E02D 5/803 254/243
2007/0040158 A1 * 2/2007 Keister ..... B66D 3/12 254/380

* cited by examiner

*Primary Examiner* — Joseph J Hail
*Assistant Examiner* — Shantese McDonald
(74) *Attorney, Agent, or Firm* — Warn Partners, P.C.

(57) ABSTRACT

A jack for raising of an exposed hub or axle of an off-road vehicle is provided. The jack has an elongated base member including an upper end and a foot portion with the upper end including a pivot attachment area. An articulating over center arm assembly is pivotably attached at the pivot attachment area of the elongated base member. The assembly includes an offset over-center arm portion with a leverage handle on a first end and a pivoting adjustable strap portion on a second end. When the strap is attached to the axle or suspension member of a hub or axle the handle may be lowered and the base pivots wherein the strap end is moved upward and temporarily secured in the up position at full actuation of the handle for raising of the wheel for removal of the wheel.

27 Claims, 8 Drawing Sheets

OPEN WHEEL VEHICLE SPEED JACK

CROSS-REFERENCE TO RELATED APPLICATIONS

This application claims the benefit of U.S. Provisional Application No. 62/238,390, filed Oct. 7, 2015. The disclosure of the above application is incorporated herein by reference.

FIELD OF THE INVENTION

The present invention relates to a jack for an open wheeled off-road vehicle.

BACKGROUND OF THE INVENTION

In the past there have been many attempts for providing jacks for raising of an off-road vehicle axle or tire when in the field of off road racing to replace a flat tire.

In off-road conditions there is rarely a good position or surface to jack up a vehicle. Typically mud, sand rocks, and other terrain conditions make it problematic to allow a normal on-road jack to jack up a vehicle high enough and consistent enough in order to change the tire. Additionally, tires in off-road vehicle applications are generally larger than normal street tires and require a higher lift. Thus, jacks for off-road applications tend to be heavy and robust and provide an extremely long level of lift. One such jack is a ratchet-type with a vertical ratchet bar and a long handle that is pumped up and down several times for any vehicle lift, and for numerous sets for adequate lift to be able to change a tire. Such jacks typically also require small components such as pins for use, which are easily broken and/or lost in off-road environments, especially when off road racing.

In off road racing applications, changing of tires must be accomplished in the same variety of terrain conditions but must be done quickly when seconds count. Additionally, weight considerations matter in the minutiae of detail which is required to win in a racing environment. Jacks typically used in racing applications include screw type jacks in which an electric drill is used in order to try and speed up the screw turning process to elevate the vehicle a foot or more in order to change the tire. These jacks are heavy and still take tens of minutes in use. These are minutes and pounds which can make enough difference to lose a race.

Therefore, there remains a need in the art to provide a robust jack which has a high amount of adjustability, light weight and speedy deployment and jacking.

SUMMARY OF THE INVENTION

A rapid deployment jack for raising of an exposed hub or axle of an off-road vehicle is provided. The jack has an elongated base member including an upper end and a foot portion with the upper end including a pivot attachment area. An articulating over-center arm assembly is pivotably attached at the pivot attachment area of the elongated base member. The over-center arm assembly includes an offset over-center arm portion with a leverage handle on a first end and a pivoting adjustable strap portion on a second end. When the strap of the pivoting adjustable strap portion is attached to the axle or suspension member of a hub or axle the leverage handle may be lowered and the base pivots wherein the strap end is moved upward and temporarily secured in the up position at full actuation of the handle for raising of the wheel for removal of the wheel.

A method of jacking up an exposed axle or tire of an off-road vehicle is also provided, comprising the steps of:

a. Providing an over-center jack structure having an adjustable strap for securing around an axle or hub of the vehicle;

b. Securing the strap to the hub or axle of the off-road vehicle, and actuating the over-center jack for raising the hub or axle of the vehicle.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawing, wherein.

DETAILED DESCRIPTION OF THE PREFERRED EMBODIMENTS

Figure 1:
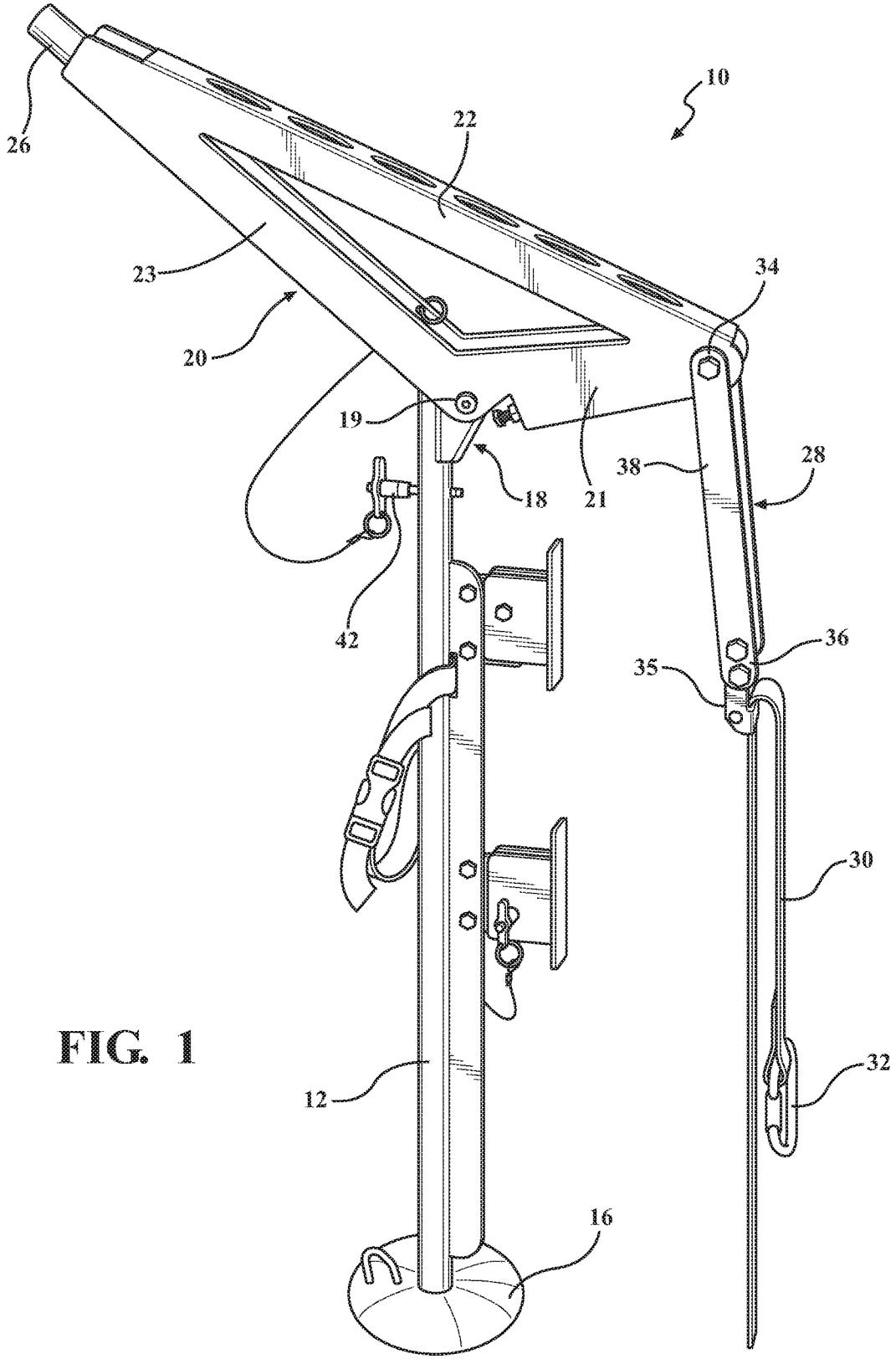
FIG. 1 is a perspective view of a off-road vehicle rapid deployment jack, with a leverage handle of the jack not attached, in accordance with the present invention.

The following description of the preferred embodiment(s) is merely exemplary in nature and is in no way intended to limit the invention, its application, or uses.

Referring to FIGS. 1-9 generally, a rapid deployment jack is provided for raising of an exposed hub or axle of an off-road vehicle 2 is generally shown at 10. The jack 10 includes an elongated base member 12 which has an upper end 14 and a foot portion 16. The upper end 14 includes a pivot attachment area shown generally at 18. An articulating over-center arm assembly shown generally at 20 is operably pivotably attached at the pivot attachment area 18 of the elongated base member 12, at pivot point 19. The articulating over-center arm assembly 20 includes an offset over-center arm portion 22 with a leverage handle 24 on a first end 26, and a pivoting portion shown generally at 28 which pivots at a first end 34, at a pivot point provided on the strap end 33 of the assembly 20, adjustable strap 30 on a second end 36 of the pivoting portion 28.

The articulating over-center arm assembly 20 is formed of rigid integrally formed links forming a generally triangular shape, preferably, a scalene triangle, most preferably, where the shortest link of the scalene is connected between the pivot attachment area 18 and pivoting portion 28. Thus, the articulating over-center arm assembly 20 has at least three portions; the over-center arm portion 22, a second arm portion 21, and a third arm portion 23.

Figure 3:
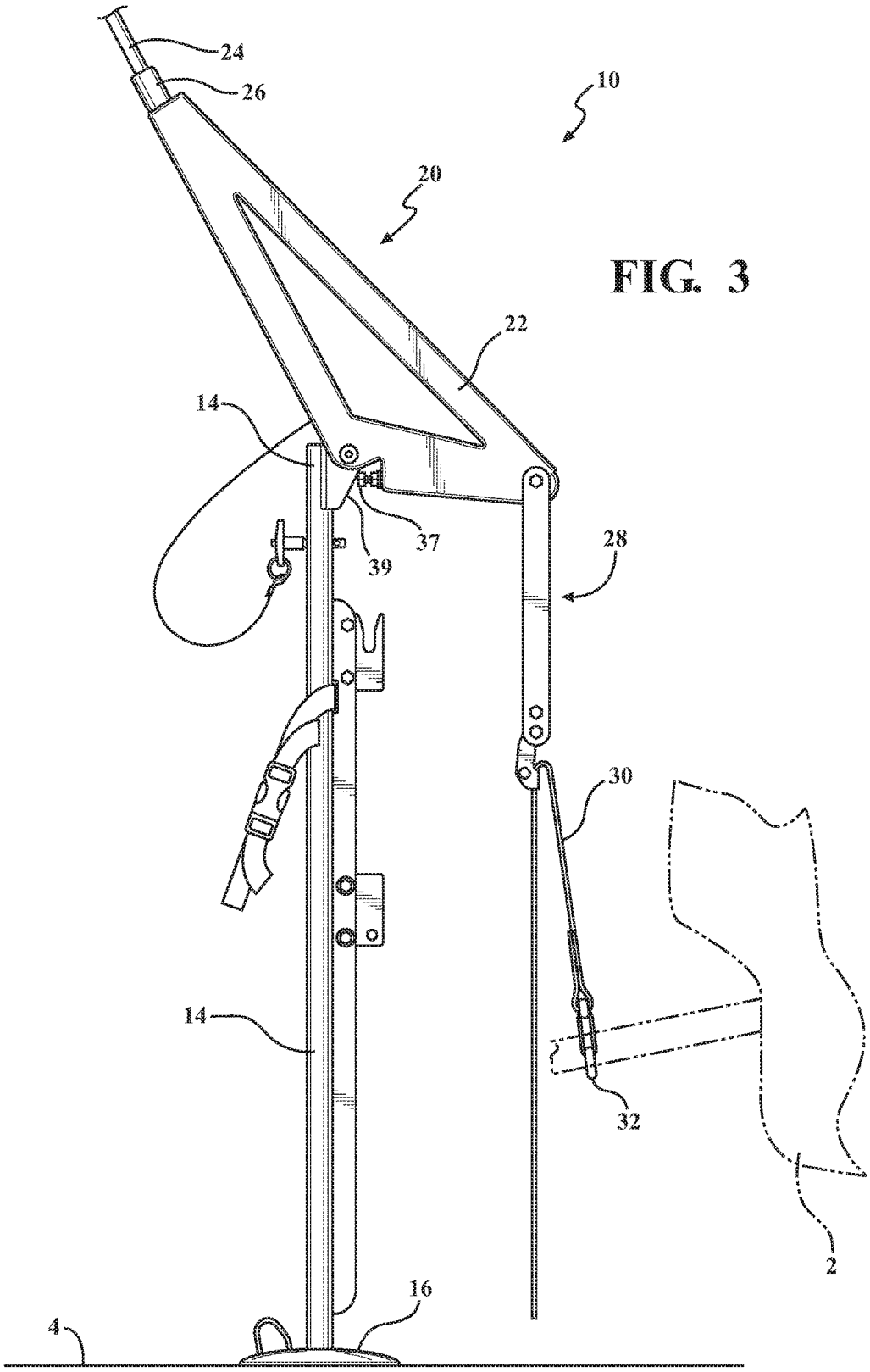
FIG. 3 is a side elevation view of the off-road vehicle rapid deployment jack made in accordance with the teachings of the present invention, with a strap lowered into position secured to the wheel axle of the vehicle and the leverage handle attached in position for jacking of the vehicle.
Figure 8:
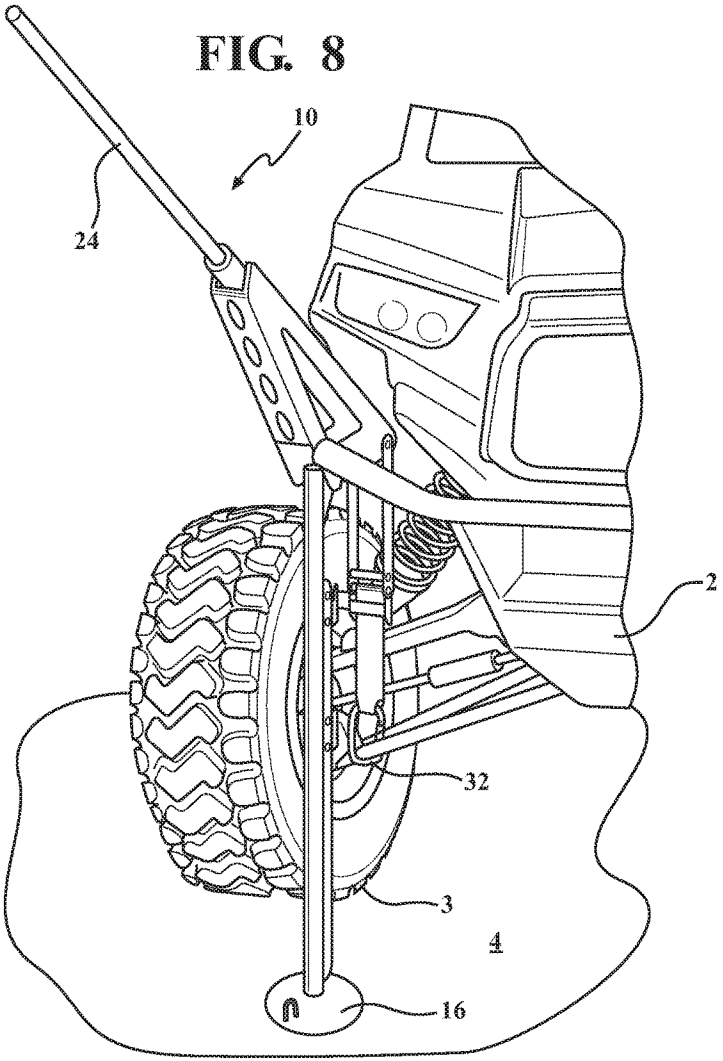
FIG. 8 is a side elevation view of the off-road vehicle rapid deployment jack made in accordance with the teachings of the present invention, with the strap lowered into position secured to the wheel axle of the vehicle and the leverage handle attached in position for jacking of the vehicle.

In operation, using the leverage handle 24 the first end 26 is pivoted in the upward direction as shown in FIGS. 3 and 8 which positions the strap end in the lowest position available. A hook portion 32 of the strap 30 is placed to engage the front axle or hub of an open wheel vehicle or any other suitable part of the vehicle and the play in the strap 30 is tightened by way of buckle or ratchet 35. Thereafter, the leverage handle 24 is lowered in the sequence shown in FIGS. 3 to 5 (and 8 to 9), and as the leverage handle 24 is lowered the elongated base member 12 pivots wherein the strap end is moved upward and temporarily secured in the up position by the over-center configuration of the over-center arm portion 22 at full actuation of the leverage handle 24. The wheel 3 is raised off the ground 4 for removal of the wheel 3. After replacement of the wheel 3 the leverage handle 24 is raised and the wheel 3 is lowered to the ground 4 as rapidly as desired.

Figure 2:
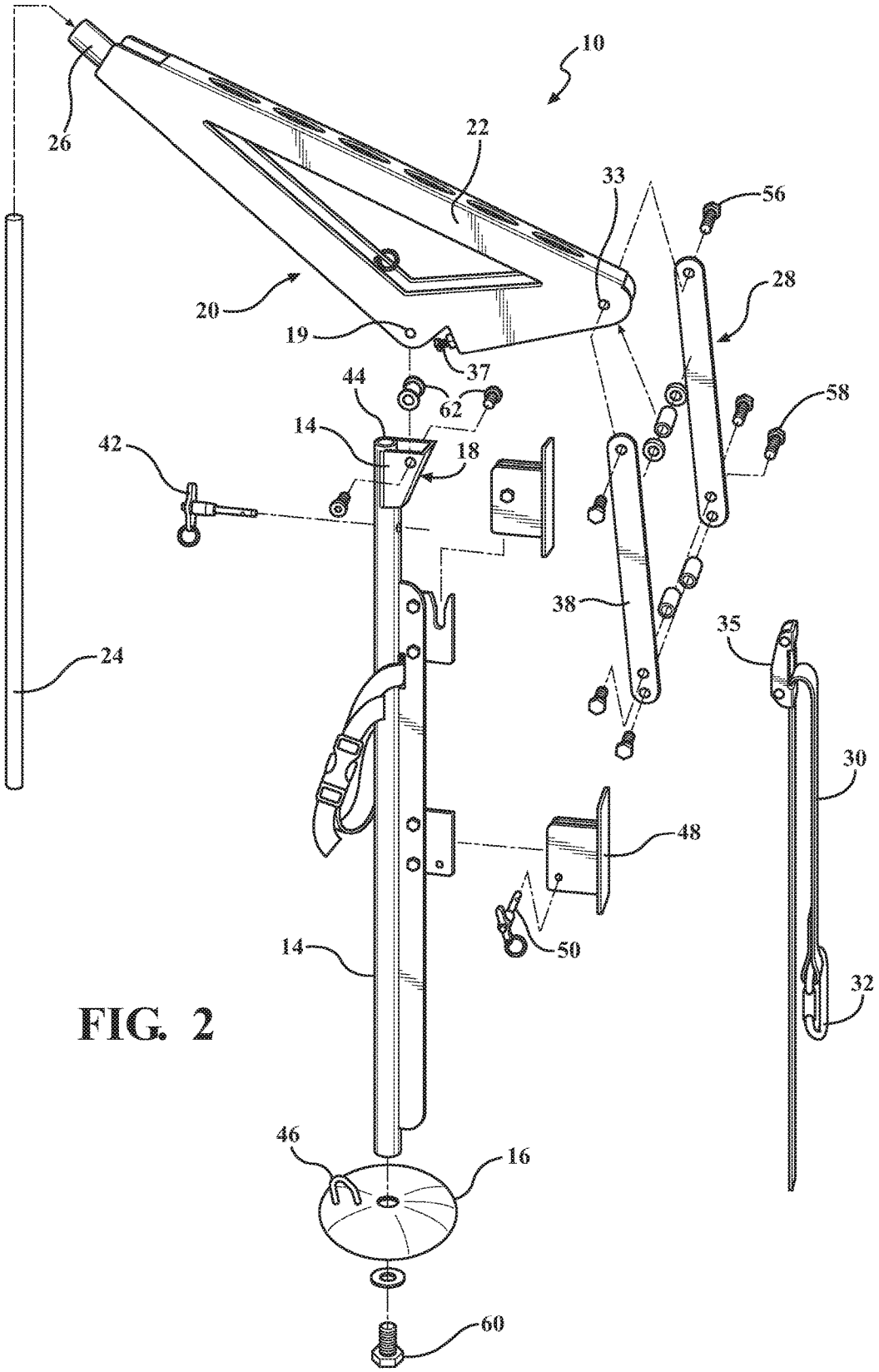
FIG. 2 is an exploded parts assembly view of the off-road vehicle jack, in accordance with the teachings of the present invention.

As can best be seen in FIG. 2, the pivoting portion 28 has at least one strap extension member 38, preferably comprised of two extension bars, for connection between the buckle 35 and the pivot at first end 34. Optionally, a series of adjustment holes are provided to raise the attachment portion of the buckle 35. The buckle 35 allows adjustment of the strap 30 length. Preferably, when length adjustment is desired, a latch on the buckle 35 is depressed allowing the desired amount of strap 30 to be pulled through the buckle 30 to lengthen or shorten the strap.

In one embodiment, an adjustment portion 37 is provided which allows the operator to selectively set the predetermined amount of tilt the over-center arm assembly 20 can have with respect to the elongated base member 12. This increases the amount of lift available. The adjustment portion 37 includes a threaded fastener that contacts a sloped surface 39 provided on the upper end 14 of the elongated base member 12 to set the tilt. Turning the adjustment portion 37 in a first direction allows the second arm portion 21 to position the strap end lower, and turning the adjustment portion 37 in a second direction allows the second arm portion 21 to position the strap end higher. FIG. 3 illustrates the second arm portion 21 at a position for allowing positioning of the strap end to the vehicle 2. When desired, adjusting the adjustment portion 37 on the over-center arm assembly 20 a predetermined amount allows the second arm portion 21 to be positioned (or angled downward) lower, e.g., further past horizontal, to position the strap end even lower, and vice versa.

Figure 4:
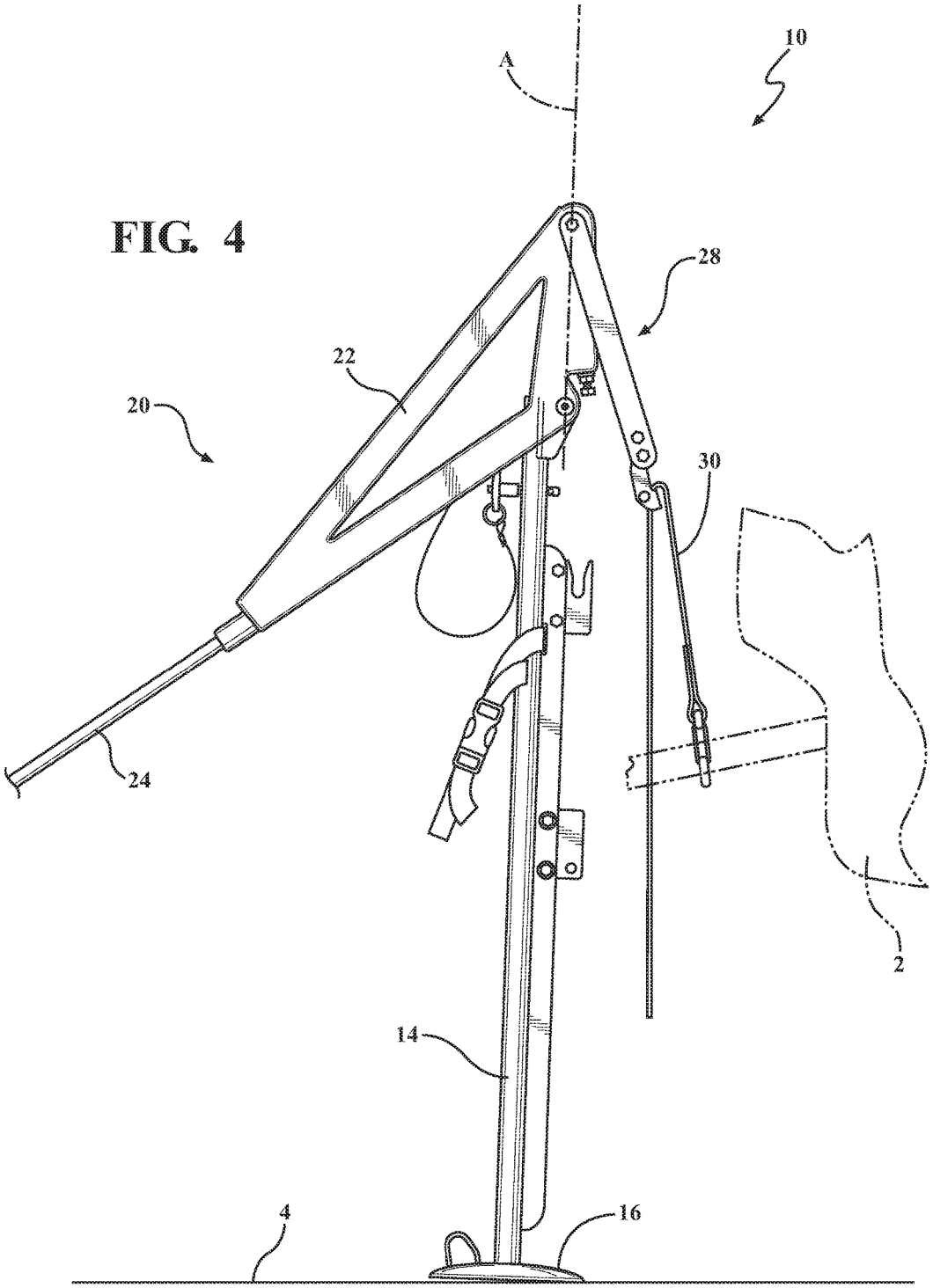
FIG. 4 is a side elevation view of the off-road vehicle rapid deployment jack with the wheel raising with the handle articulating downward.
Figure 5:
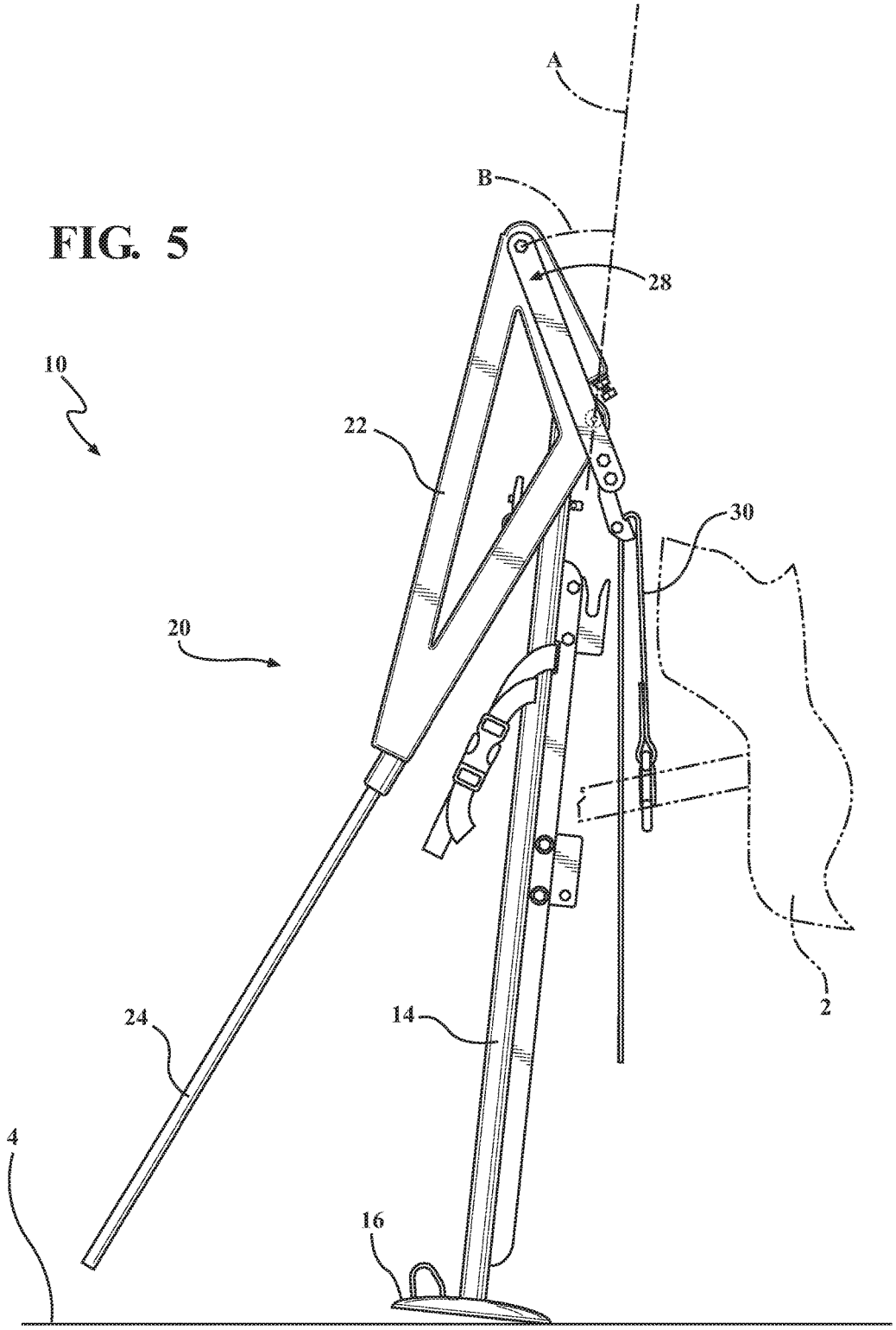
FIG. 5 is a side elevation view of the off-road vehicle rapid deployment jack with the wheel in a raised position with the handle fully articulated downward.
Figure 7:
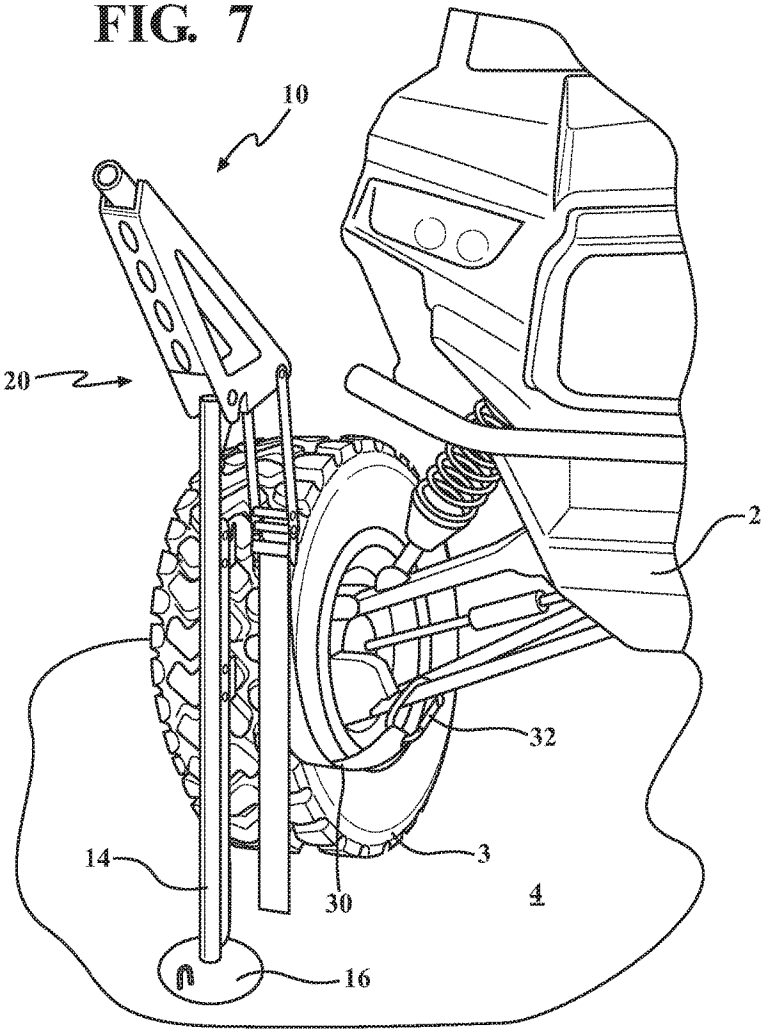
FIG. 7 is a perspective view the off-road vehicle rapid deployment jack illustrated in an environment of use with the strap lowered into position and secured to the wheel axle of the vehicle.
Figure 6:
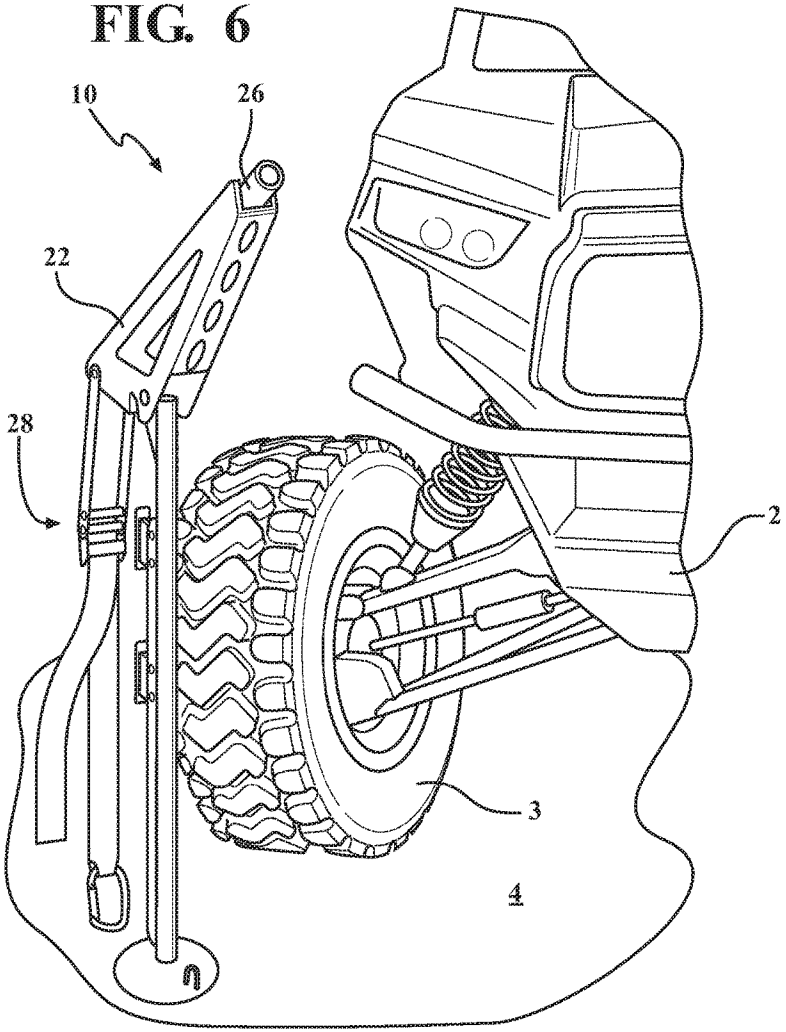
FIG. 6 is a perspective view the off-road vehicle rapid deployment jack illustrated in an environment of use.
Figure 9:
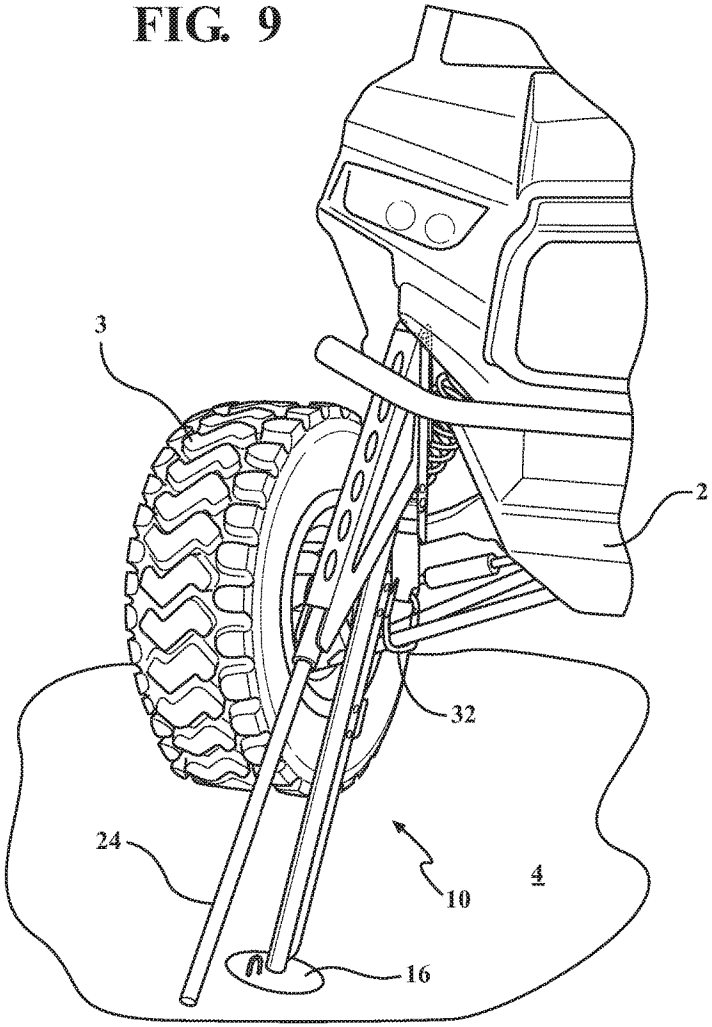
FIG. 9 a side elevation view of the off-road vehicle rapid deployment jack with the wheel in the raised position with the handle fully articulated downward.

FIG. 4 illustrates the over-center arm assembly 20 moved generally to a full upright position with its normal center of gravity, indicated by axis line "A", and FIG. 5 illustrates the over-center arm assembly 20 having moved further past the center of gravity, indicated by "B".

A push pin member 42 is also provided for securing the leverage handle 24 in the hollowed leg 44 of the elongated base member 12 for storage of the handle 24. Pulling the push pin member 42 out allows the leverage handle 24 to slide out of the elongated base member 12, and the push pin member 42 is tethered to prevent the pin 42 from being lost.

Figure 10:
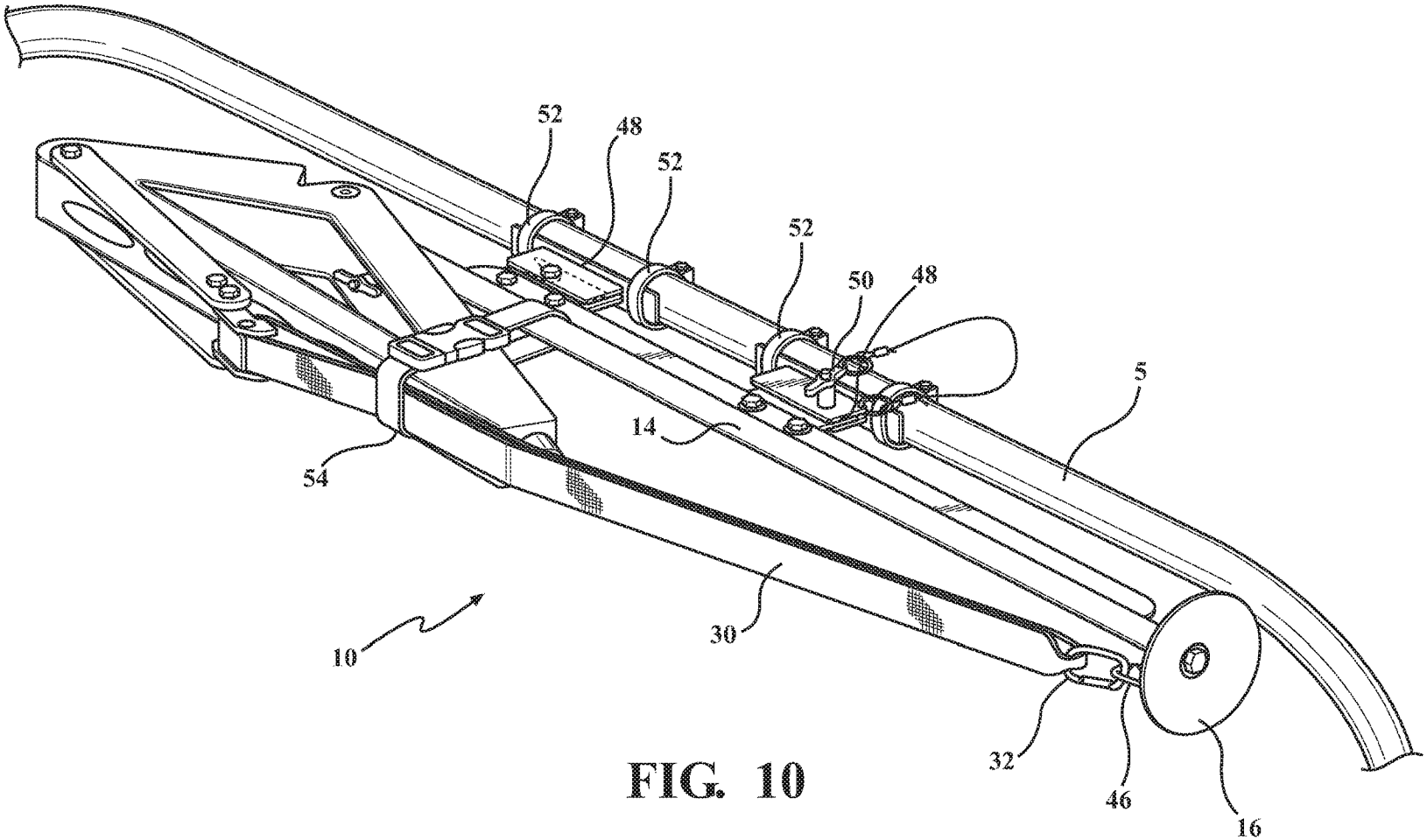
FIG. 10 is a perspective view of the off-road vehicle rapid deployment jack mounted to a sport bar of a vehicle, in accordance with an embodiment of the present invention.

Referring to FIG. 10, a loop 46 is provided on the foot portion 16 for the hook 32 to connect to for storage. At least one, preferably two, mounting brackets 48 are also provided to selectively connect the jack 10 to the vehicle 2 for stowing when not in use. The mounting brackets 48 are connected to the elongated base member 12 with a plurality of fasteners and/or at least one push pin 48. The mounting brackets 48 operably connect to the vehicle 2 structure such as to sport parts/roll bars 5. According to one embodiment, clamps 52 are used to hold the brackets 48 to the sport bar 5. Another push pin 50 is provided to hold the clamps 52 when not in use to prevent clamps 52 from being lost. Another strap 54 is provided to secure the over-center arm assembly 20 against the elongated base member 12 for storage.

Referring to the Figures generally, the pivoting portion 28 is connected at pivot point of the strap end 33 of the assembly 20 with at least one fastener 56, e.g., bolts, trundle, spacer, threaded member, washers, rivets, screws, etc and/or combinations thereof. The buckle 35 is connected at the second end 36 of the pivotal portion 28 with at least one fastener 58, e.g., bolts, trundle, spacer, threaded member, washers, rivets, screws, etc and/or combinations thereof. The foot portion 60 is connected to the leg of the elongated base member 12 with at least one fastener 60. The over-center arm assembly 20 is pivotably attached at the pivot attachment area 18 of the elongated base member 12 with at least one fastener 62, e.g., bolts, trundle, spacer, threaded member, washers, rivets, screws, etc and/or combinations thereof.

Preferably, the foot portion 16 is generally disk shaped. However, any other shape suitable for off-road applications is contemplated without departure from the scope of the present invention. It is also within the scope of the present invention for at least a portion of the foot portion to be operably adapted depending on the application for positioning a larger surface area generally flat on the ground 4 when the jack 10 is deployed without departure from the present invention, e.g., hinged piece, flat surface member, etc.

The over-center arm assembly, pivoting portion, elongated base member, and/or leverage handle are steel. However, other lighter weight materials are contemplated depending on the application without departure from the scope of the present invention.

In operation, the jack of the present invention is a rapid deployment jack particularly useful in off road racing applications. As will be readily appreciated by those skilled in the art this jack is much faster than currently used jacks. It is lightweight, compact and easily stored. The jack is also much less cumbersome than the hydraulic, pneumatic, or screw jacks commonly employed. The jack of the present invention is easy to employ and only requires the securement of a strap to a suitable wheel location. With the leverage of the off-center linkage one easy handle pull raises the vehicle wheel at least 3-6" off the ground in less than a second. Lowering of the jack is just as fast. The adjustability of travel can be varied widely over a foot or two or more and allows for jacking of vehicles in a variety of off-road terrains. Thus, the jack is extremely versatile and extremely useful in off road racing conditions.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A rapid deployment jack for raising of an exposed hub or axle of an off-road vehicle, comprising:

an elongated base member including an upper end and a foot portion; and an articulating over-center arm assembly operably pivotably attached at a pivot attachment area of the upper end, said over-center arm assembly including an offset over-center arm portion with a leverage handle on a first end and a pivoting portion on a strap end, said pivoting portion having an adjustable strap attachable to the vehicle, wherein with the adjustable strap attached to the axle or a suspension member of the hub or axle, when the leverage handle is lowered the elongated base member pivots wherein the strap end is moved upward and temporarily secured in the up position at full actuation of the leverage handle for raising of a wheel for removal of the wheel;

wherein the over-center arm assembly comprises the offset over-center arm portion, a second arm portion and a third arm portion forming a scalene triangle.

2. The rapid deployment jack of claim 1, wherein the second arm portion is located between the pivot attachment area and strap end of the over-center arm assembly.

3. The rapid deployment jack of claim 2, wherein the second arm portion is shorter than the offset over-center arm portion and third arm portion.

4. The rapid deployment jack of claim 2, further comprising an adjustment portion operably connected to the second arm portion to set a predetermined amount of downward tilt of the second arm portion.

5. The rapid deployment jack of claim 1, further comprising an adjustment portion operably connected to the over-center arm assembly, said adjustment portion coming into contact with the elongated base member when the leverage handle is fully upward to set how low the strap end can move.

6. The rapid deployment jack of claim 5, wherein the attachment area of the upper end includes a sloped surface for the adjustment portion to contact, wherein turning the adjustment portion in a first direction increases how low the strap end can move, and wherein turning the adjustment portion in a second direction decreases how low the strap end can move.

7. The rapid deployment jack of claim 1, further comprising a hollowed leg of the elongated base member to stow the leverage handle when the jack is not in use.

8. The rapid deployment jack of claim 7, further comprising a push pin member to secure the leverage handle within the hollowed leg.

9. The rapid deployment jack of claim 1, further comprising at least one mounting bracket for mounting the rapid deployment jack to the vehicle sport bar when the jack is not in use.

10. The rapid deployment jack of claim 1, wherein the adjustable strap further includes a buckle operably connected to the pivoting portion to adjust the length of the strap.

11. The rapid deployment jack of claim 10, wherein the pivoting portion further comprises at least one strap extension member pivotably connected at a first end to the over-center arm assembly and operably connected to the buckle at a second end, wherein as the leverage handle is lowered, in turn moving the offset over-center arm portion with the leverage handle, the adjustable strap moves upward as the offset over-center arm assembly moves past a center of gravity until in the up position at full actuation of the leverage handle.

12. The rapid deployment jack of claim 1, wherein the elongated base member further comprises a loop for securing the strap when not in use.

13. The rapid deployment jack of claim 1, wherein the pivoting adjustable strap portion is operably connected to the assembly with at least one fastener and pivots downward as the second end moves upward.

14. The rapid deployment jack of claim 13, wherein the over-center arm assembly comprises the offset over-center arm portion, a second arm portion and a third arm portion forming a scalene triangle, where the second arm portion is the shortest and is pivotably attached to the elongated base member and the adjustable strap portion, wherein as the leverage handle is lowered, in turn moving the offset over-center arm portion with the leverage handle, the strap moves upward as the offset over-center arm assembly moves past a center of gravity until in the up position at full actuation of the leverage handle.

15. A rapid deployment jack for raising of an exposed hub or axle of an off-road vehicle, comprising:

an elongated base member including an upper end and a foot portion; and an articulating over-center arm assembly operably pivotably attached at a pivot attachment area of the upper end, said over-center arm assembly including an offset over-center arm portion, second arm portion and a third arm portion forming a scalene triangle, said over-center arm portion including a leverage handle on a first end and a pivoting portion on a strap end, said pivoting portion having an adjustable strap attachable to the vehicle, wherein with the adjustable strap attached to the axle or a suspension member of the hub or axle, when the leverage handle is lowered the elongated base member pivots wherein the strap end is moved upward and temporarily secured in the up position at full actuation of the leverage handle for raising of a wheel for removal of the wheel;

wherein the second arm portion is located between the pivot attachment area and strap end of the over-center arm assembly.

16. The rapid deployment jack of claim 15, wherein the second arm portion is shorter than the offset over-center arm portion and third arm portion.

17. The rapid deployment jack of claim 15, further comprising an adjustment portion operably connected to the second arm portion to set a predetermined amount of downward tilt of the second arm portion.

18. The rapid deployment jack of claim 15, further comprising an adjustment portion operably connected to the over-center arm assembly, said adjustment portion coming into contact with the elongated base member when the leverage handle is fully upward to set how low the strap end can move.

19. The rapid deployment jack of claim 18, wherein the attachment area of the upper end includes a sloped surface for the adjustment portion to contact, wherein turning the adjustment portion in a first direction increases how low the strap end can move, and wherein turning the adjustment portion in a second direction decreases how low the strap end can move.

20. The rapid deployment jack of claim 15, further comprising a hollowed leg of the elongated base member to stow the leverage handle when the jack is not in use.

21. The rapid deployment jack of claim 20, further comprising a push pin member to secure the leverage handle within the hollowed leg.

22. The rapid deployment jack of claim 15, further comprising at least one mounting bracket for mounting the rapid deployment jack to the vehicle sport bar when the jack is not in use.

23. The rapid deployment jack of claim 15, wherein the adjustable strap further includes a buckle operably connected to the pivoting portion to adjust the length of the strap.

24. The rapid deployment jack of claim 23, wherein the pivoting portion further comprises at least one strap extension member pivotably connected at a first end to the over-center arm assembly and operably connected to the buckle at a second end, wherein as the leverage handle is lowered, in turn moving the offset over-center arm portion with the leverage handle, the adjustable strap moves upward as the offset over-center arm assembly moves past a center of gravity until in the up position at full actuation of the leverage handle.

25. The rapid deployment jack of claim 15, wherein the elongated base member further comprises a loop for securing the strap when not in use.

26. A rapid deployment jack for raising of an exposed hub or axle of an off-road vehicle, comprising:

an elongated base member including an upper end and a foot portion;

an articulating over-center arm assembly operably pivotably attached at a pivot attachment area of the upper end, said over-center arm assembly including an offset over-center arm portion with a leverage handle on a first end and a pivoting portion on a strap end, said pivoting portion having an adjustable strap attachable to the vehicle, wherein with the adjustable strap attached to the axle or a suspension member of the hub or axle, when the leverage handle is lowered the elongated base member pivots wherein the strap end is moved upward and temporarily secured in the up position at full actuation of the leverage handle for raising of a wheel for removal of the wheel; and a hollowed leg of the elongated base member to stow the leverage handle when the jack is not in use.

27. A rapid deployment jack for raising of an exposed hub or axle of an off-road vehicle, comprising:

an elongated base member including an upper end and a foot portion;

an articulating over-center arm assembly operably pivotably attached at a pivot attachment area of the upper end, said over-center arm assembly including an offset over-center arm portion with a leverage handle on a first end and a pivoting portion on a strap end, said pivoting portion having an adjustable strap attachable to the vehicle, wherein with the adjustable strap attached to the axle or a suspension member of the hub or axle, when the leverage handle is lowered the elongated base member pivots wherein the strap end is moved upward and temporarily secured in the up position at full actuation of the leverage handle for raising of a wheel for removal of the wheel; and at least one mounting bracket for mounting the rapid deployment jack to the vehicle sport bar when the jack is not in use.

* * * * *